US005694805A

United States Patent [19]

Schnell et al.

[11] Patent Number: 5,694,805

[45] Date of Patent: Dec. 9, 1997

[54] TRAVELLING CLAMP WITH REMOVABLE RAILS

[75] Inventors: Richard E. Schnell, Oswego, Ill.; Douglas P. Miller, New Berlin, Wis.; James F. Grimes, Naperville, Ill.; Patrick J. Yeko, Menomonee Falls, Wis.

[73] Assignee: Applied Power Inc., Butler, Wis.

[21] Appl. No.: 682,947

[22] Filed: Jul. 16, 1996

[51] Int. Cl.[6] ..... B21D 37/14

[52] U.S. Cl. ..... 72/481.2; 72/446

[58] Field of Search ..... 72/481.1, 481.2, 72/481.6, 482.8, 446

[56] References Cited

U.S. PATENT DOCUMENTS

| | | | |
|---|---|---|---|
| 4,674,315 | 6/1987 | Linz | 72/481.2 |
| 4,698,894 | 10/1987 | Lingaraju et al. | 72/481.2 |
| 4,790,174 | 12/1988 | Wendland | 72/481.2 |

FOREIGN PATENT DOCUMENTS

| | | | |
|---|---|---|---|
| 2-11231 | 1/1990 | Japan | 72/446 |
| 2-112832 | 4/1990 | Japan | 72/481.2 |

OTHER PUBLICATIONS

Applicant's Exhibit A, cover pages and pp. 20–21 of of Enerpac Automation Systems Brochure, admitted prior art.

Applicant's Exhibit B, Enerpac Drawing No. DA11639.690 entitled "Adaptor Block"; dated Dec. 19, 1994; admitted prior art.

*Primary Examiner*—David Jones
*Attorney, Agent, or Firm*—Quarles & Brady

[57] ABSTRACT

A travelling clamp unit of the type for extending and retracting a T-head clamping cylinder into and out of a T-slot of a press has a main frame which supports clamping cylinder drive means and the clamping cylinder when it is in a parked position in which it is retracted from the T-slot of the press. The main frame has rails which support the clamping cylinder T-head in the parked position and which are removable from the main frame so that the T-head can be dropped out of the bottom end of the main frame for removing the clamping cylinder from the travelling clamp unit.

3 Claims, 6 Drawing Sheets

TRAVELLING CLAMP WITH REMOVABLE RAILS

BACKGROUND OF THE INVENTION

1. Field of the Invention

This invention relates to travelling clamps of the type for clamping a mold or die in a press, and in particular to a travelling clamp for extending and retracting a T-head clamp into and out of T-slots of the press.

2. Discussion of the Prior Art

FIG. 1 illustrates a prior art press in which a lower die 1 is secured to the bolster platen 2 of the press and an upper die 3 is secured to the slide platen 4 of the press. As shown in FIGS. 2, 3 and 5, the slide platen 4 is provided with a number of spaced T-slots 5 in which the T-shaped clamp head 6 of a hydraulically operated travelling clamp 7 can be slidably received. The unit 7 has drive means including an electric motor 9 which drives sprocket 13 in engagement with chain 8 so as to extend clamp head 6 into and out of the T-slot 5 with which it is aligned when the upper die 3 is to be attached against the platen or confronting face of the slide 4. Clamping cylinder 10 is then hydraulically actuated, with hydraulic pressure supplied by hose 11, so as to bear with the rod end of the cylinder against a flange of the die 3 to clamp the die 3 tightly against the platen of the slide 4. T-slots may also be provided in the bolster platen 2 for automatically clamping the lower die 1 to the bolster platen 2 using travelling clamps 7, as shown in FIG. 3.

In the prior art, once a travelling clamp unit 7 was assembled to the press, it was not possible to remove the clamping cylinder 10 from the travelling clamp unit without substantial disassembly of the unit 7. However, since this was sometimes desirable, for example, if the clamping cylinder 10 had to be replaced but the remainder of the travelling unit did not, a large hole was cut in the press in the center of each T-slot 5 so that the clamping cylinder 10 could be extended to that position and the T-head 6 dropped out of the T-slot 5. The shuttle chain 8 (or other movement device) and hydraulic hose 11 could then be detached from the clamping cylinder 10, and the cylinder repaired or replaced, reinstalling the T-head 6 to the T-slot through the same hole formed in the press platen 4.

This method of clamping cylinder removal is at times very inconvenient. These times particularly occur when there is a die secured to the press platen. When that is the case, the die must be removed before the clamping cylinder can be repaired or replaced. This can be a very time consuming, and therefore expensive in terms of machine downtime, operation.

SUMMARY OF THE INVENTION

The invention provides an improved travelling clamp unit of the type described above which provides a solution to the above problem. In a travelling clamp unit of the invention, the frame includes a main frame for supporting the drive means of the clamping cylinder and means secured to the main frame blocking removal of the T-head of the cylinder from the main frame. The blocking means is removeable from the main frame to permit removal of the T-head from the main frame, thereby permitting removal of the clamping cylinder from the unit. Thus, machining a hole in the T-slot to remove the T-head is obviated, and the clamping cylinder can be removed from the press without removing the die.

In a preferred form, the blocking means comprises rails secured to the main frame for supporting the T-head of the clamping cylinder beneath shoulders of the T-head in the parked position of the cylinder. The rails are removable from the main frame so that the T-head can be removed from the main frame through a bottom end of the main frame, thereby obtaining removal of the clamping cylinder from the travelling clamp unit in an easy and cost effective manner.

These and other objects and advantages of the invention will be apparent from the detailed description and drawings.

DETAILED DESCRIPTION OF THE PREFERRED EMBODIMENT

Figure 1:
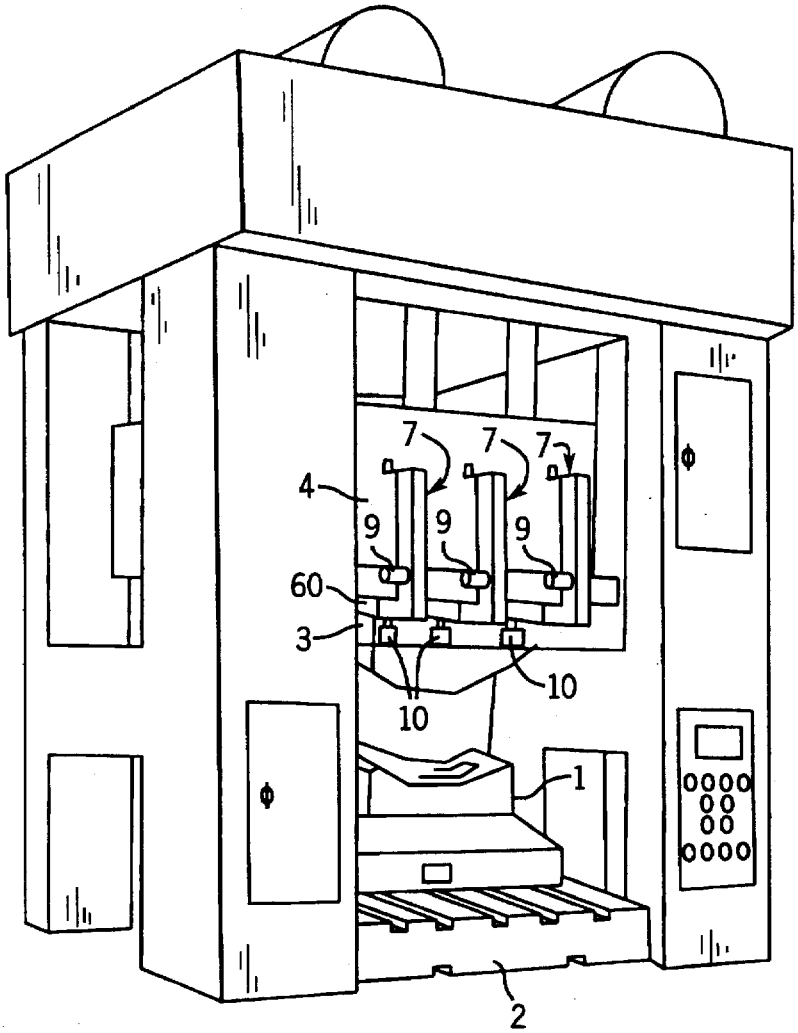
FIG. 1 PRIOR ART
FIG. 1 is a perspective view of a typical press configuration employing travelling clamps 7 for securing a metal stamping die 3 to the slide platen 4 of the press.
Figure 2:
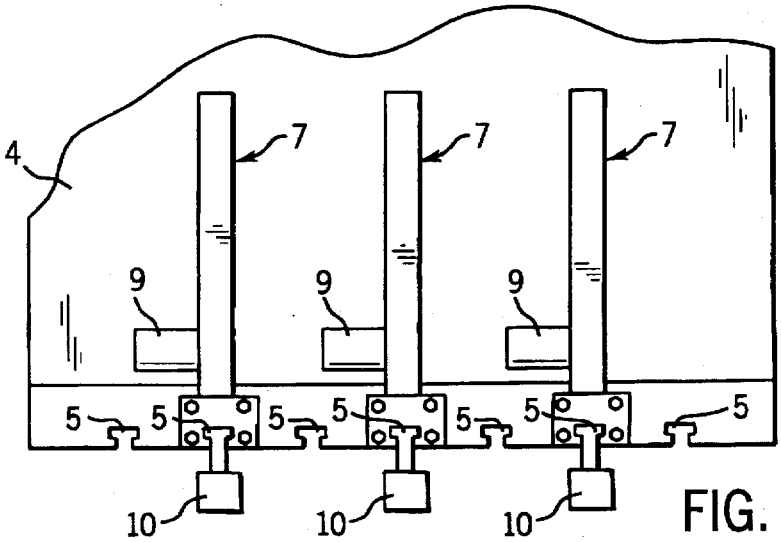
FIG. 2 PRIOR ART
FIG. 2 is a front elevation fragmentary view illustrating the travelling clamps 7 and the T-slots 5 in the slide platen 4 of the press, without the die 3.
Figure 3:
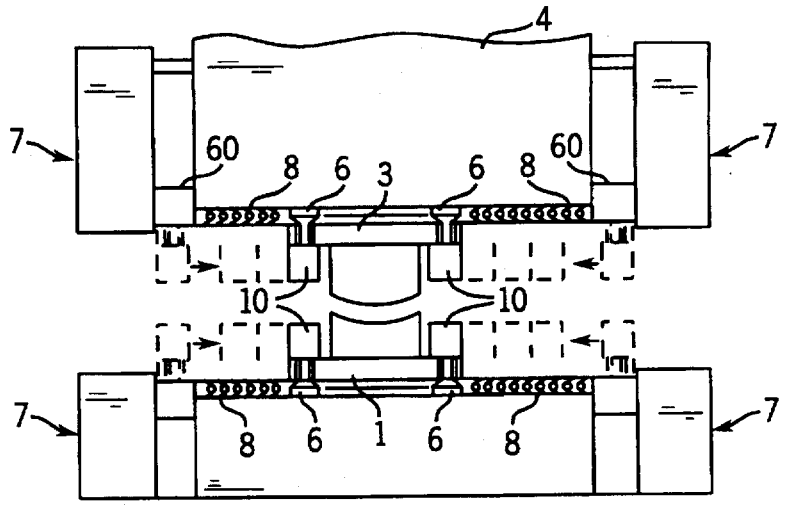
FIG. 3 PRIOR ART
FIG. 3 is a schematic elevation view illustrating the travelling clamps 7 in an extended position clamping the upper die 3 to the slide platen 4 of a press. Units 7 are also illustrated clamping the lower die 1 to the bolster platen 2.

Referring particularly to FIGS. 6–11, a travelling clamp 20 of the preferred embodiment differs from the prior art in that rails 22 and 24, which are identical to one another, are removable from the side plates 26 and 28 of the main frame 30. In prior art travelling clamps, the rails were integral with the side plates or other parts of the main frame so that they were not separately removable from the main frame. As discussed above, this required the T-shaped head 6 of the cylinder 10 to be extended into the T-slots 5 of the platen 4 and a large hole formed near the center of the platen 4 so that the T-head 6 could be removed from the T-slot 5 once aligned with the hole.

Figure 4:
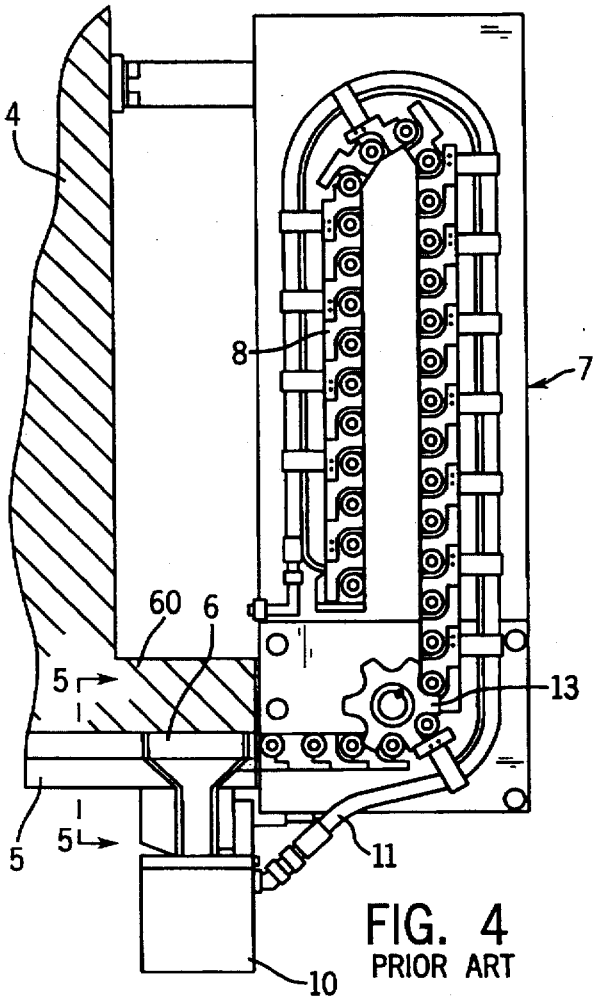
FIG. 4 PRIOR ART
FIG. 4 is a schematic view illustrating the basic operating components of a typical prior art travelling clamp 7 of the type that is incorporated in the present invention, with the clamp head 6 partially extended into the T-slot 5 of a flange 60 of the slide platen 4.
Figure 5:
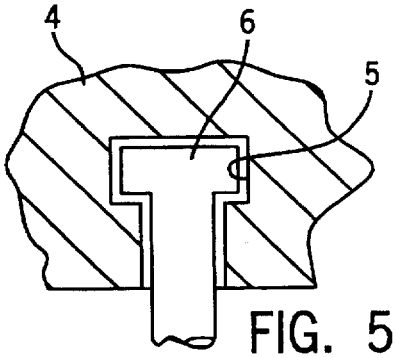
FIG. 5 PRIOR ART
FIG. 5 is a fragmentary sectional view as viewed from the plane of the line 5—5 of FIG. 4 illustrating a T-slot 5 in the slide platen 4 of the press with the T-shaped head 6 of the clamping cylinder 10 supported in the T-slot 5.
Figure 6:
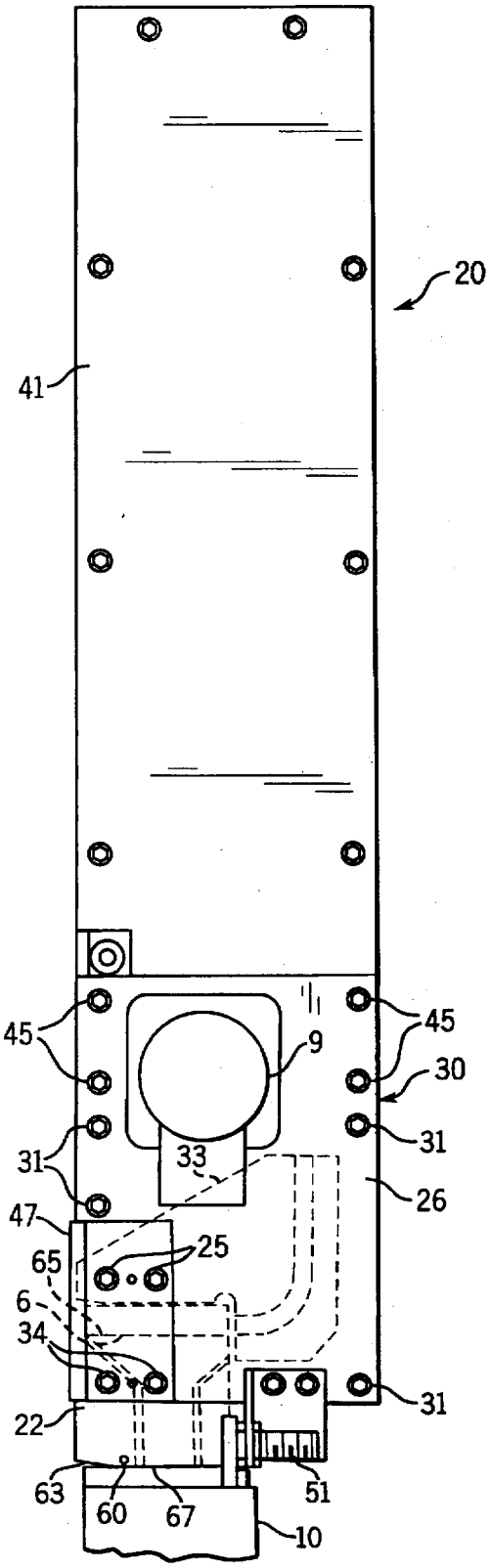
FIG. 6 is a side plan view of a travelling clamp of the invention (hydraulic hose not shown)
Figure 7:
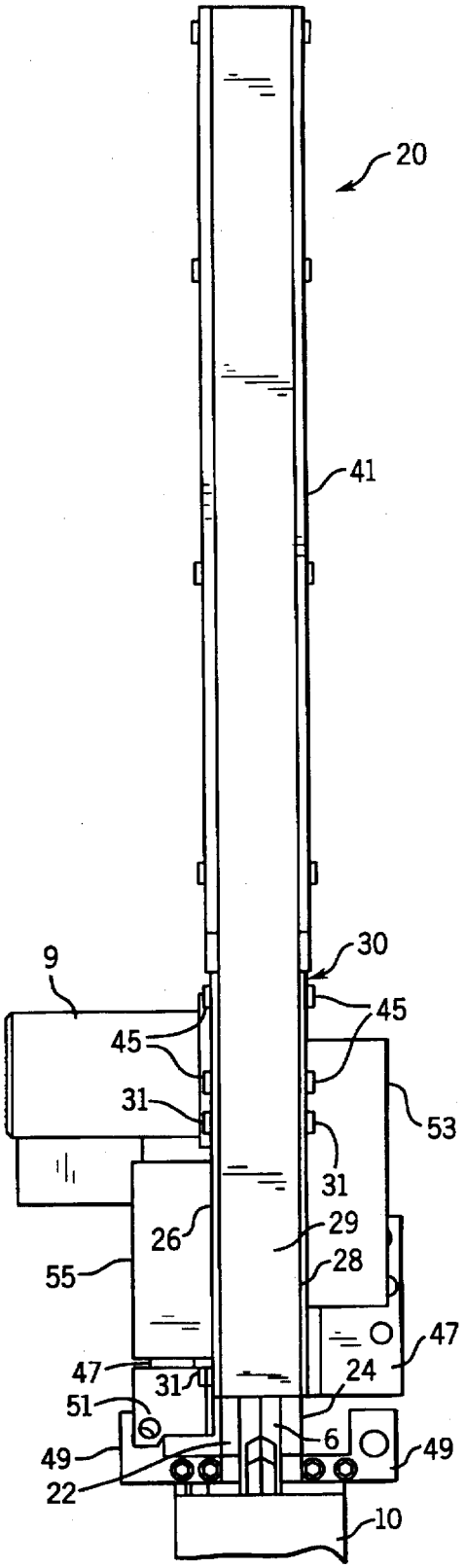
FIG. 7 is a front plan view of the travelling clamp of FIG. 6 (hydraulic hose not shown)
Figure 8:
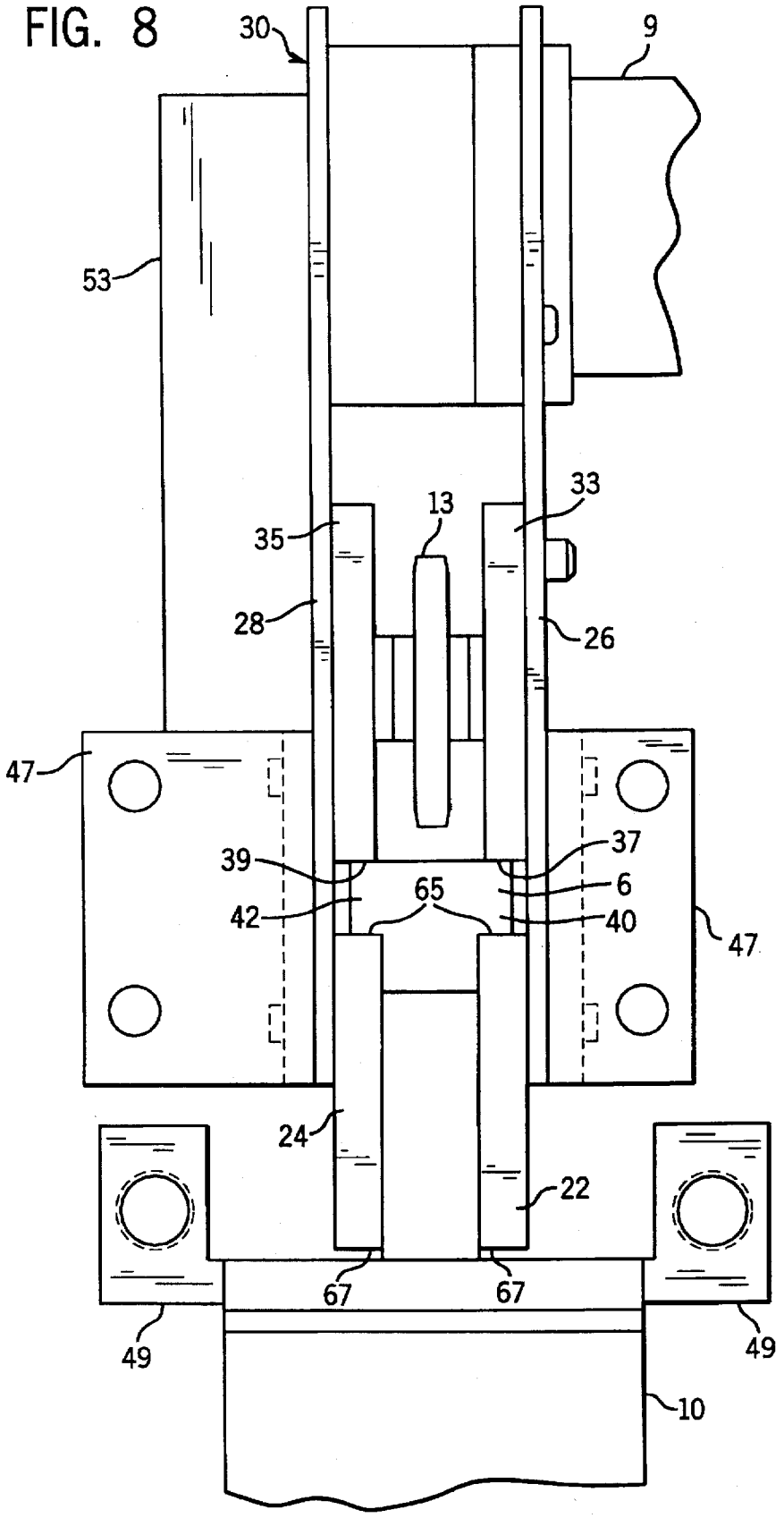
FIG. 8 is a rear plan view with the rear spacer channel, chain and upper enclosure removed.

With a travelling clamp of the invention, each rail 22 or 24 is secured to its corresponding side plate 26 or 28, respectively, by two screws 34 (FIGS. 6 and 10) which extend through the corresponding side plate 26 or 28 and are threaded into tapped holes 36 (FIGS. 9 and 11) in the corresponding rail 22 and 24. Thus, removal of the T-head 6 and cylinder 10 from the travelling clamp 20 is effected by removing the screws 34 and removing the rails 22 and 24 from the bottom of the main frame 30. Since this removes the support under the side flanges 40 and 42 of the T-head 6, which normally blocks removal of the cylinder 10 from the main frame 30, the T-head 6 can be dropped down through the bottom of the main frame 30 and be removed from the chain 8 by removing either the two screws 44 which hold the chain 8 to the chain mounting bracket 46 or by removing the two screws 48 which hold the chain mounting bracket 46 to the T-head 6. The hydraulic hose 11 (FIG. 4, not shown in FIGS. 6-11 for clarity) would also be removed from the cylinder 10 to remove the cylinder 10 from the unit 20.

Each rail 22 or 24 also has a lower hole 60 which is provided primarily for the purpose of securing the unit 7 during shipping, so that a pin or other device can be inserted through the holes 60 to lock the head 6 inside the main frame 30. In addition, each rail 22 or 24 preferably has a tapered leading edge 61 and 63 on its upper 65 and lower 67 sides so as to provide a smooth transition for the T-head 6 when it enters the unit 20.

The main frame 30 includes the side plates 26 and 28, which are steel, and steel channels 27 and 29 which space apart the side plates 26 and 28 and are secured to the side plates 26 and 28 by screws 31. The main frame thus defines and encloses the space between the plates 26 and 28 and spacer channels 27 and 29 in which the sprocket 13 is mounted to drive the chain 8 and provides support for the mechanical drive of the chain 8, including the motor 9, sprocket 13, and housing 53, which encloses the drive mechanism between the motor 9 and the sprocket 13. Housing 55 covers an electrical terminal strip (not shown) for making electrical connections to the unit 20 on the side opposite from the drive housing 53.

Sprocket supports 33 and 35 in which the sprocket 13 is journaled are secured to the adjacent respective plates 26 and 28 by suitable means such as screws 25 or welding to support the sprocket 13 and provide upper stops 37 and 39 to prevent T-head 6 from lifting up above the rails 22 and 24, particularly when it is pushed by the chain 8. The side plates 26 and 28 extend above the spacer channels 27 and 29 to support the upper enclosure 41, which is secured to the side plates 26 and 28 by screws 45. Mounting brackets 47 may be provided to mount the unit 20 to a press and sensor mounts 49 may be provided on the cylinder 10. A sensor 51 may also be secured to the main frame 30 for giving an indication of when the T-head 6 and cylinder 10 are in the parked position.

The drive means and upper enclosure of the travelling clamp unit 20 may be made by any suitable means. Such means, for example, are as incorporated in a travelling clamp manufactured by Enerpac, Butler, Wis., as Model No. TRA, which is a chain drive unit. Other drive mechanisms, however, may also be employed, such as a belt or cable drive (rather than a chain drive as disclosed), a direct air or hydraulic cylinder drive, an air cylinder and chain, belt, or cable drive, an air or hydraulic motor drive with chain, belt, or cable, or an electric motor, hydraulic motor, or air motor with worm gear drive.

Figure 9:
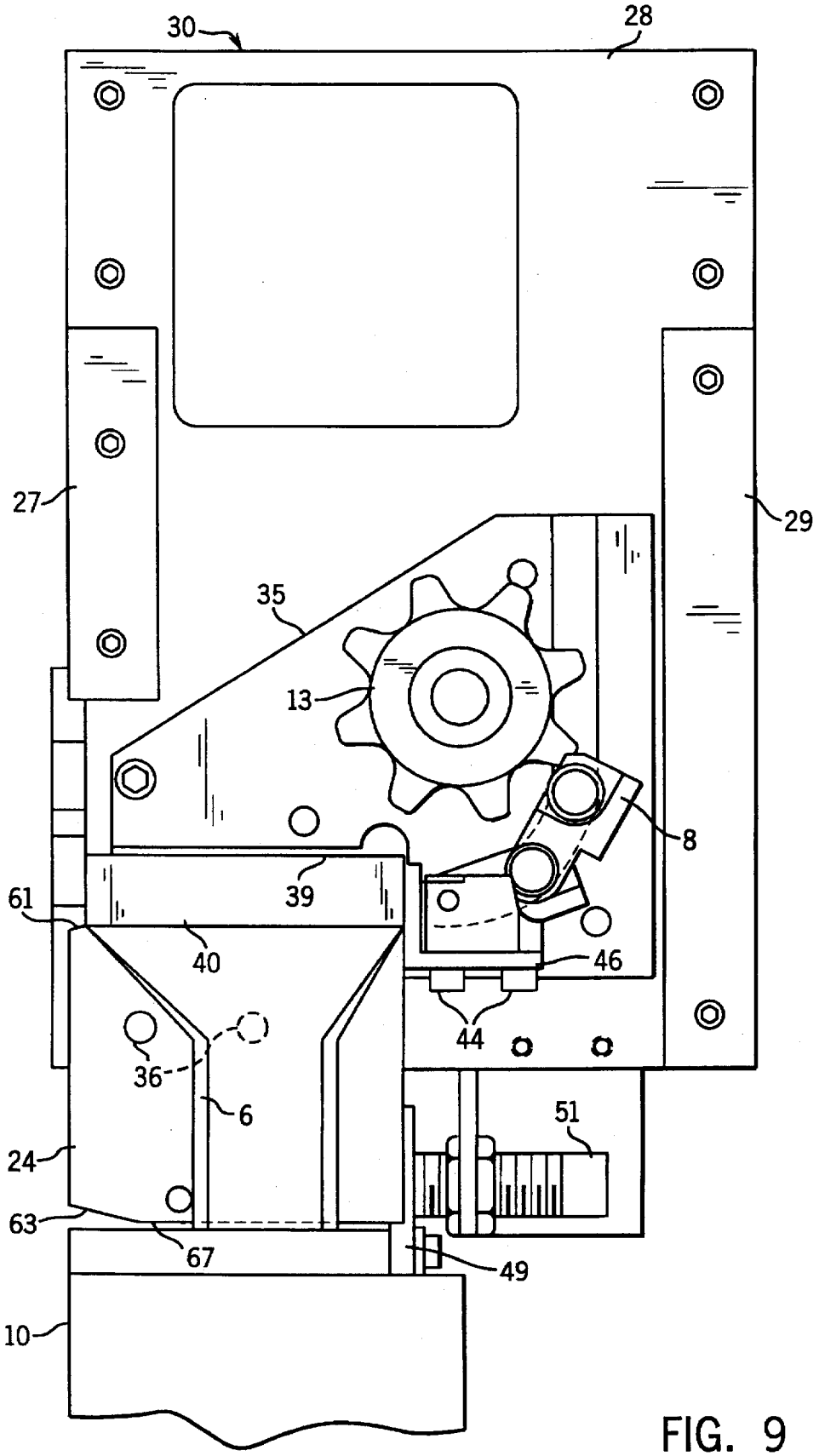
FIG. 9 is a left side plan view with the left side plate, left rail, hydraulic hose and upper enclosure removed, and showing the chain fragmentary.
Figure 10:
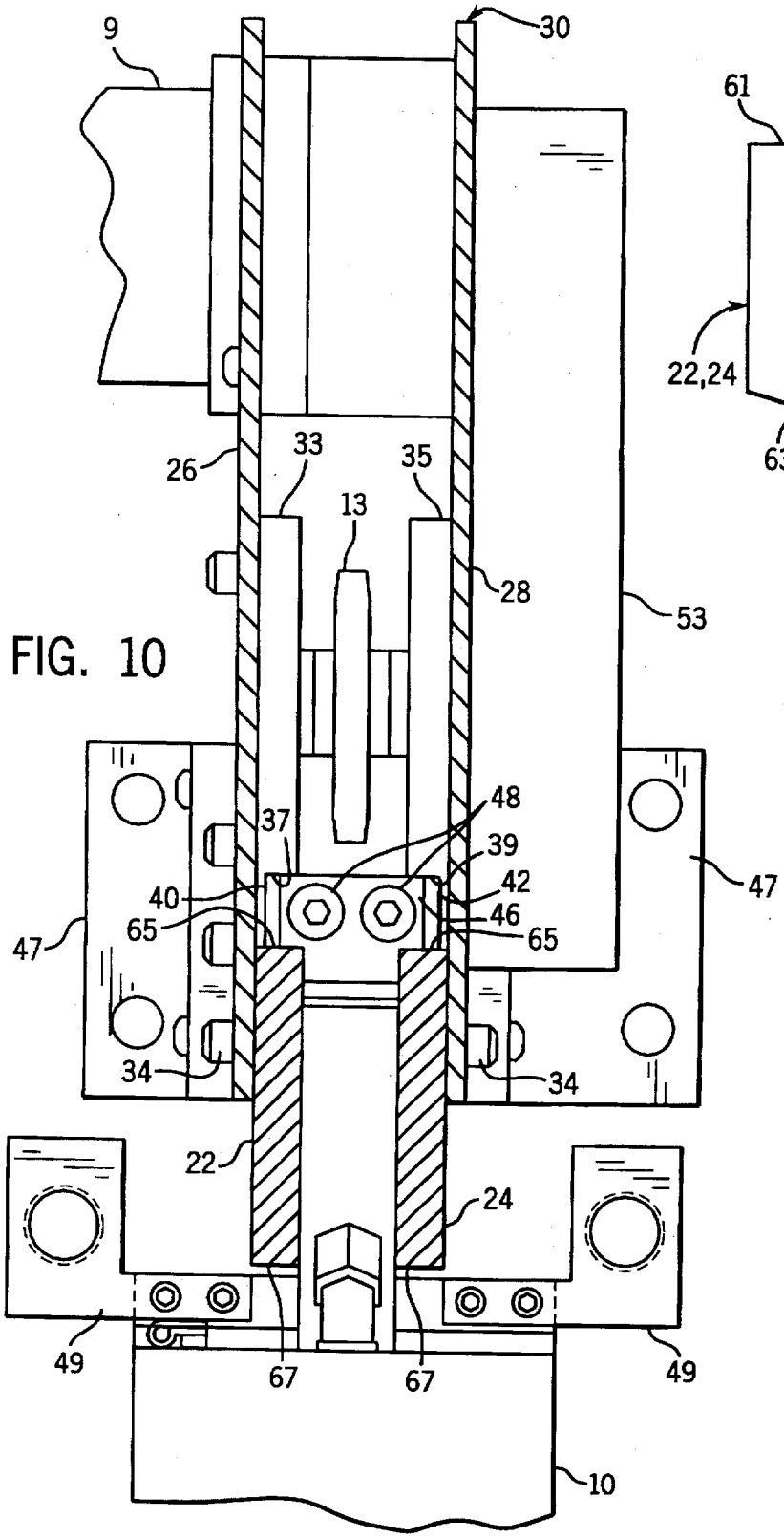
FIG. 10 is a front plan view of the travelling clamp with the front spacer channel, chain and upper enclosure removed.
Figure 11:
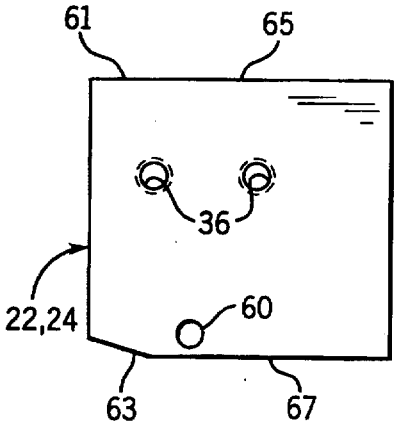
FIG. 11 is a side plan view of one of the rails incorporated in the travelling clamp of FIGS. 6–10.

In the "parked" position of the cylinder 10 and T-head 6, illustrated in FIG. 9, in which the head 6 is supported on the rails 22 and 24, the cylinder 10 may be pressurized so as to bear against the upper and lower surfaces 65, 67 and compress the rails 22 and 24 between the top of the cylinder 10 (the rod end of the cylinder 10) and the flanges 40 and 42 of the T-head 6. This prevents the T-head 6 and cylinder 10 from creeping out of the parked position into the T-slot of the press, which otherwise may occur from the weight of the chain 8 tending to push the T-head 6 out of the travelling clamp main frame 30.

A travelling clamp 20 may be applied to many different types of press installations. As shown in the figures, the clamp 20 may be affixed to the side of the press to service a single T-slot. Alternatively, the clamp 20 may be incorporated in a biaxial travelling clamp as shown and described in copending, commonly owned U.S. patent application Ser. No. 08/682,944, filed on the same day as this application, entitled "Biaxial Travelling Clamp For Securing a Tool to a Press", the disclosure of which is hereby incorporated by reference.

Many modifications and variations to the preferred embodiment which incorporate the invention will be apparent to those skilled in the art. Therefore, the invention should not be limited to the embodiment described but should be defined by the claims which follow.

We claim:

1. In a travelling clamp unit of the type for extending and retracting a T-head clamping cylinder into and out of a T-slot of a press, said unit having power drive means secured to said clamping cylinder for extending and retracting said clamping cylinder into and out of said T-slot and a frame for supporting said drive means and said clamping cylinder when said clamping cylinder is in a parked position in which said clamping cylinder is retracted from said T-slot of said press, the improvement wherein said frame includes a main frame for supporting said drive means and rails secured to sidewalls of said main frame for supporting said T-head of said clamping cylinder beneath shoulders of said T-head in a parked position of said cylinder in which said cylinder is supported between sidewalls of said main frame, said rails being removeable from said sidewalls of said main frame to permit removal of said T-head from said main frame, thereby permitting removal of said clamping cylinder from said unit.

2. In a travelling clamp unit of the type for extending and retracting a T-head clamping cylinder into and out of a T-slot of a press, said unit having power drive means secured to said clamping cylinder for extending and retracting said clamping cylinder into and out of said T-slot and a frame for supporting said drive means and said clamping cylinder when said clamping cylinder is in a parked position in which said clamping cylinder is retracted from said T-slot of said press, the improvement wherein said frame includes a main frame for supporting said drive means and blocking means secured to said main frame blocking removal of said T-head of said cylinder from said main frame, said blocking means being removeable from said main frame to permit removal of said T-head from said main frame, thereby permitting removal of said clamping cylinder from said unit, wherein said blocking means comprises rails secured to said main frame for supporting said T-head of said clamping cylinder beneath shoulders of said T-head in said parked position of said cylinder, said rails being removable from said main frame so that said T-head can be removed from said main frame through a bottom end of said main frame.

3. The improvement of claim 2, wherein said rails are removeably secured to side plates of said main frame.

* * * * *